US012501936B2

(12) United States Patent
Yoon et al.

(10) Patent No.: US 12,501,936 B2
(45) Date of Patent: Dec. 23, 2025

(54) AEROSOL GENERATING ARTICLE, AEROSOL GENERATING DEVICE, AND AEROSOL GENERATING SYSTEM

(71) Applicant: KT&G CORPORATION, Daejeon (KR)

(72) Inventors: Sung Wook Yoon, Gyeonggi-do (KR); Seung Won Lee, Gyeonggi-do (KR); Dae Nam Han, Gyeonggi-do (KR); Yong Hwan Kim, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 1072 days.

(21) Appl. No.: 17/268,642

(22) PCT Filed: Aug. 13, 2020

(86) PCT No.: PCT/KR2020/010728

§ 371 (c)(1),
(2) Date: Feb. 16, 2021

(87) PCT Pub. No.: WO2021/034004

PCT Pub. Date: Feb. 25, 2021

(65) Prior Publication Data

US 2022/0295892 A1 Sep. 22, 2022

(30) Foreign Application Priority Data

Aug. 16, 2019 (KR) ..... 10-2019-0100533

(51) Int. Cl.
*A24F 40/465* (2020.01)
*A24F 40/20* (2020.01)
*A24F 40/57* (2020.01)

(52) U.S. Cl.
CPC ..... *A24F 40/465* (2020.01); *A24F 40/20* (2020.01); *A24F 40/57* (2020.01)

(58) Field of Classification Search
CPC ..... A24F 40/465; A24F 40/46; A24F 40/20; A24F 40/51; A24F 40/57
See application file for complete search history.

(56) References Cited

U.S. PATENT DOCUMENTS 8,678,016 B2 3/2014 Snaidr et al.
10,779,569 B2 9/2020 Roudier et al.
(Continued)

FOREIGN PATENT DOCUMENTS

CN 108135266 A 6/2018
JP 2016-531572 A 10/2016
(Continued)

OTHER PUBLICATIONS

Office Action issued Mar. 29, 2023 in Chinese Application No. 202080005607.2.
(Continued)

*Primary Examiner* — Michael H. Wilson
*Assistant Examiner* — Stephanie Lynn Moore
(74) *Attorney, Agent, or Firm* — Sughrue Mion, PLLC

(57) ABSTRACT

An aerosol generating system includes an aerosol generating article accommodated in an aerosol generating device to generate an aerosol when heated by the heater, wherein the aerosol generating article comprises: a base portion configured to generate the aerosol when heated; a medium portion arranged at a downstream end of the base portion; and a thermally conductive wrapper surrounding at least a portion of each of the base portion and the medium portion, and configured to transfer heat from the heater, and wherein the heater is arranged to surround the aerosol generating article such that a surface area of the base portion surrounded by the heater is larger than a surface area of the medium portion surrounded by the heater.

13 Claims, 5 Drawing Sheets

(56) References Cited

U.S. PATENT DOCUMENTS

| | | | | |
|---|---|---|---|---|
| 11,234,457 | B2 | 2/2022 | Mironov et al. | |
| 2015/0053219 | A1* | 2/2015 | Roudier | A24F 42/10 131/329 |
| 2016/0120221 | A1* | 5/2016 | Mironov | A24F 40/42 392/395 |
| 2018/0146713 | A1* | 5/2018 | Robinson | A24F 40/42 |
| 2018/0310622 | A1 | 11/2018 | Mironov et al. | |
| 2019/0000133 | A1 | 1/2019 | Park et al. | |
| 2019/0159517 | A1 | 5/2019 | Ballesteros Gomez et al. | |
| 2019/0166909 | A1 | 6/2019 | Reevell | |
| 2020/0093185 | A1 | 3/2020 | Lim | |
| 2020/0128880 | A1* | 4/2020 | Gage | A24F 42/60 |
| 2020/0359688 | A1 | 11/2020 | Jang et al. | |
| 2021/0106046 | A1* | 4/2021 | Courbat | A24F 40/53 |

FOREIGN PATENT DOCUMENTS

| | | | |
|---|---|---|---|
| KR | 10-0822698 | B1 | 4/2008 |
| KR | 10-2015-0048869 | A | 5/2015 |
| KR | 10-2017-0123689 | A | 11/2017 |
| KR | 10-2018-0069895 | A | 6/2018 |
| KR | 10-2018-0129637 | A | 12/2018 |
| KR | 10-2018-0134914 | A | 12/2018 |
| KR | 10-2019-0021439 | A | 3/2019 |
| KR | 10-2019-0038301 | A | 4/2019 |
| KR | 10-2019-0093026 | A | 8/2019 |
| KR | 10-2019-0093027 | A | 8/2019 |
| WO | 2019/151687 | A1 | 8/2019 |
| WO | 2019/151688 | A1 | 8/2019 |

OTHER PUBLICATIONS

International Search Report of PCT/KR2020/010728 dated Dec. 30, 2020 [PCT/ISA/210].

Written Opinion of PCT/KR2020/010728 dated Dec. 30, 2020 [PCT/ISA/237].

Korean Office Action of KR 10-2019-0100533 dated Dec. 22, 2020.

Extended European Search Report dated Sep. 23, 2021 in Application No. 20855175.4.

* cited by examiner

AEROSOL GENERATING ARTICLE, AEROSOL GENERATING DEVICE, AND AEROSOL GENERATING SYSTEM

CROSS REFERENCE TO RELATED APPLICATIONS

This application is a National Stage of International Application No. PCT/KR2020/010728 filed on Aug. 13, 2020, claiming priority based on Korean Patent Application No. 10-2019-0100533 filed on Aug. 16, 2019.

TECHNICAL FIELD

One or more embodiments of the present disclosure relate to a method and apparatus for generating an aerosol, and more particularly, to a method and apparatus for heating an aerosol generating article accommodated in an aerosol generating device to a desired temperature.

BACKGROUND ART

Recently, the demand for alternatives to overcome traditional cigarettes has increased. For example, there is growing demand for aerosol generating devices that generate aerosol by heating an aerosol generating material in an aerosol generating article (e.g., cigarette), rather than by combusting an aerosol generating article. Accordingly, studies on a heating-type aerosol generating article and a heating-type aerosol generating device have been actively conducted.

DISCLOSURE

Technical Solution

In general, the position of a heater within an aerosol generating device significantly affects the taste of the aerosol. Therefore, for a good taste of the aerosol, the aerosol generating article containing an aerosol generating material should not be overheated. On the other hand, in order to increase the amount of vapor (i.e., atomization) within the aerosol generating article, the aerosol generating article needs to be heated to a relatively high temperature. Therefore, it is difficult to satisfy these conflicting conditions.

One or more embodiments of the present disclosure provide an aerosol generating article, an aerosol generating device, and an aerosol generating system that are able to solve such problems. Embodiments of the present disclosure are not limited thereto. It is to be appreciated that other embodiments will be apparent to those skilled in the art from consideration of the specification and the accompanying drawings of the present disclosure described herein.

Advantageous Effects

According to one or more embodiments of the present disclosure, a base portion and a medium portion of an aerosol generating article may be heated to different temperatures, respectively. In particular, the base portion may be heated at a higher temperature than the medium portion. Therefore, a burned taste due to overheating of the medium portion may be prevented and a good taste may be provided. Also, by heating the base portion to a high temperature, rich vapor may be generated.

Embodiments of the present disclosure are not limited thereto. It is to be appreciated that other embodiments will be apparent to those skilled in the art from consideration of the specification and the accompanying drawings of the present disclosure described herein.

BEST MODE

Figure 1:
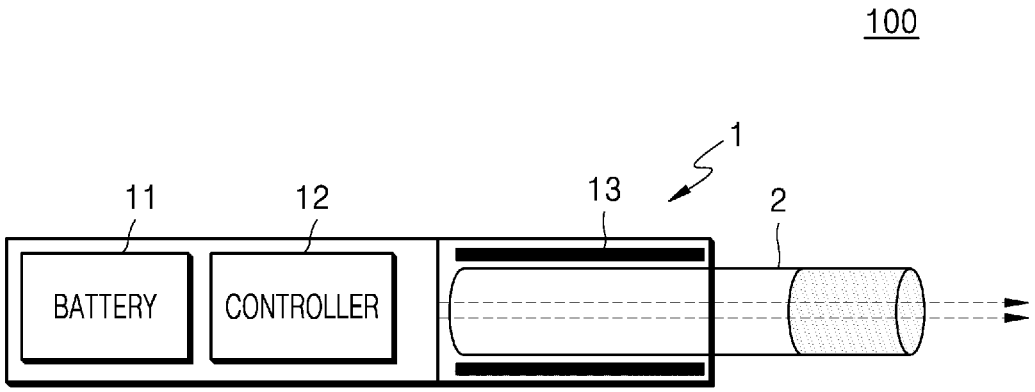
FIG. 1 is a cross-sectional view schematically illustrating an aerosol generating system according to an embodiment of the present disclosure.

According to an aspect of the present disclosure, an aerosol generating device including a battery and a heater for generating heat from electric power supplied by the battery; and an aerosol generating article accommodated in the aerosol generating device to generate an aerosol when heated by the heater, wherein the aerosol generating article comprises: a base portion configured to generate the aerosol when heated; a medium portion arranged at a downstream end of the base portion; and a thermally conductive wrapper surrounding at least a portion of each of the base portion and the medium portion and configured to transfer heat from the heater, and wherein the heater is arranged to surround the aerosol generating article such that a surface area of the base portion surrounded by the heater is larger than a surface area of the medium portion surrounded by the heater.

A ratio of the surface area of the medium portion surrounded by the heater to the surface area of the base portion surrounded by the heater is within a range of 0.5 to 0.9.

The aerosol generating article may further include a cooling portion arranged at a downstream end of the medium portion, and a downstream end of the heater is spaced apart from the cooling portion in a longitudinal direction of the aerosol generating article.

The aerosol generating article may further include a mouthpiece portion arranged at a downstream end of the cooling portion, and a distance between the downstream end of the heater and an upstream end of the cooling portion is greater than a distance between an upstream end of the heater and an upstream end of the base portion.

According to another aspect of the present disclosure, a heater within an aerosol generating system includes a coil surrounding at least a portion of an aerosol generating article to generate an induced magnetic field and a susceptor including a ferromagnetic substance arranged between the coil and the aerosol generating article to generate heat resulting from the induced magnetic field, wherein the susceptor is arranged to surround the aerosol generating article to heat at least a portion of each of the base portion and the medium portion, and wherein a surface area of the base portion surrounded by the susceptor is larger than a surface area of the medium portion surrounded by the susceptor.

A ratio of the surface area of the medium portion surrounded by the susceptor to the surface area of the base portion surrounded by the susceptor is within a range of 0.5 to 0.9.

The aerosol generating article may further include a cooling portion arranged at a downstream end of the medium portion, and a downstream end of the susceptor is spaced apart from the cooling portion in a longitudinal direction of the aerosol generating article.

The upstream end of the base portion may be spaced apart from an upstream end of the susceptor in the longitudinal direction of the aerosol generating article.

The aerosol generating article may further include a mouthpiece portion arranged at a downstream end of the cooling portion, and a distance between the downstream end of the susceptor and an upstream end of the cooling portion is greater than a distance between the upstream end of the susceptor and the upstream end of the base portion.

According to another aspect of the present disclosure, an aerosol generating article includes a base portion that generates an aerosol when heated, a medium portion arranged at a downstream end of the base portion; and a thermally conductive wrapper surrounding at least a portion of each of the base portion and the medium portion and configured to transfer heat, wherein the thermally conductive wrapper comprises a first wrapper portion surrounding the base portion and a second wrapper portion surrounding the medium portion, such that an amount of heat transferred through the first wrapper portion is greater than an amount of heat transferred through the second wrapper portion.

A thickness of the first wrapper portion may be less than a thickness of the second wrapper portion.

A surface area of the first wrapper portion may be larger than a surface area of the second wrapper portion.

A thermal conductivity coefficient of the first wrapper portion may be greater than a thermal conductivity coefficient of the second wrapper portion.

According to another aspect of the present disclosure, an aerosol generating device includes a space configured to accommodate an aerosol generating article that generates an aerosol when heated; a battery; and a heater configured to generate heat from electric power supplied by the battery, wherein the aerosol generating article comprises a base portion that generates the aerosol when heated, a medium portion arranged at a downstream end of the base portion, and a thermally conductive wrapper surrounding at least a portion of each of the base portion and the medium portion, wherein the heater is arranged to surround the aerosol generating article such that a surface area of the base portion surrounded by the heater is larger than a surface area of the medium portion surrounded by the heater.

The heater may include a coil surrounding at least a portion of the aerosol generating article to create an induced magnetic field; and a susceptor including a ferromagnetic substance and arranged between the coil and the aerosol generating article to generate heat resulting from the induced magnetic field.

MODE FOR INVENTION

With respect to the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Throughout the specification, an aerosol generating device may include a device that generates an aerosol using an aerosol generating material to generate an aerosol that may be inhaled by a user. For example, the aerosol generating device may include a holder that is combined with an aerosol generating article (e.g., cigarette or a cartridge) containing an aerosol generating material.

Throughout the specification, the term "puff" may refer to inhalation of the user, and the inhalation may refer to a user's action of pulling the aerosol into the user's nasal cavity or lungs through the user's mouth or nose.

In the following embodiments, the terms "upstream" and "downstream" are terms used to indicate relative positions of segments constituting an aerosol generating article, based on a direction in which the user inhales air using the aerosol generating article. The aerosol generating article includes an upstream end portion (i.e., a portion where air enters) and a downstream end portion (i.e., a portion where air exits) opposite the upstream end portion. When using the aerosol generating article, the user may bite the downstream end portion of the aerosol generating article. The downstream end portion is located downstream of the upstream end portion.

In the drawings, the size of components may be exaggerated or reduced for ease of description. For example, the size and thickness of each component shown in the drawings are arbitrarily represented for ease of description. However, embodiments of the present disclosure are not limited thereto.

Hereinafter, the present disclosure will now be described more fully with reference to the accompanying drawings, in which embodiments of the present disclosure are shown such that one of ordinary skill in the art may easily understand the inventive concept. The disclosure may, however, be embodied in many different forms and should not be construed as being limited to the embodiments set forth herein.

Figure 2:
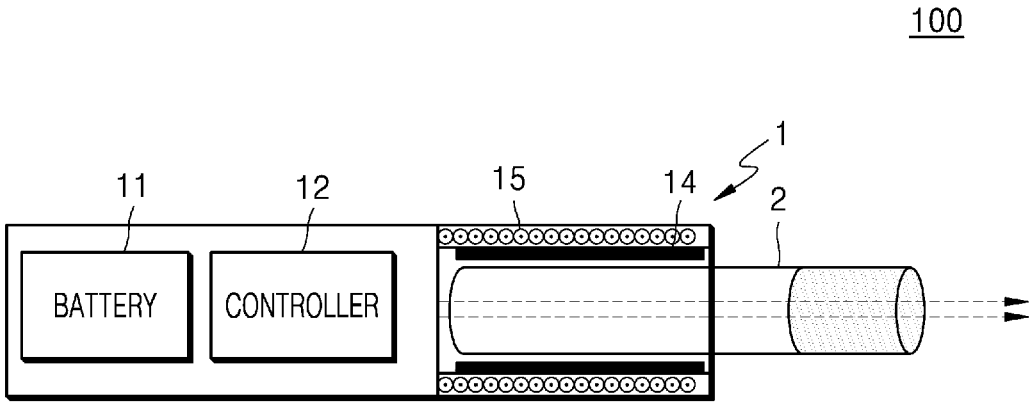
FIG. 2 is a cross-sectional view schematically illustrating an aerosol generating system according to another embodiment of the present disclosure.

With reference to FIGS. 1 and 2, an aerosol generating system including an aerosol generating device and an aerosol generating article will be described in detail.

FIG. 1 is a cross-sectional view schematically illustrating an aerosol generating system according to an embodiment of the present disclosure.

Referring to FIG. 1, an aerosol generating system 100 includes an aerosol generating device 1 and an aerosol generating article 2, wherein the aerosol generating device 1 includes a battery 11 and a controller 12, and a heater 13.

FIG. 1 only illustrates certain components of the aerosol generating device 1 which are particularly related to the present embodiment. Therefore, it may be understood by those skilled in the art related to the present embodiment that other components may be further included in the aerosol generating device 1.

In FIG. 1, the battery 11, the controller 12, and the heater 13 are illustrated as being arranged in a line. However, embodiments of the present disclosure are not limited thereto. In other words, according to the design of the aerosol generating device 1, the arrangement of the battery 11, the controller 12, and the heater 13 may be changed.

When the aerosol generating article 2 is inserted into the aerosol generating device 1, the aerosol generating device 1 may heat the heater 13. The temperature of an aerosol generating material in the aerosol generating article 2 is raised by the heated heater 13, and an aerosol may be generated, accordingly. The generated aerosol is delivered to a user through a filter of the aerosol generating article 2.

If necessary, even when the aerosol generating article 2 is not inserted into the aerosol generating device 1, the aerosol generating device 1 may heat the heater 13.

The battery 11 supplies electric power used in operating the aerosol generating device 1. For example, the battery 11 may supply electric power for the heater 13 to be heated, and also for the controller 12 to operate. The battery 11 may also supply electric power needed for a display, sensor, motor, and the like installed within the aerosol generating device 1 to operate. For example, the battery 11 may include a lithium ion battery, a nickel-based battery (e.g., a nickel-metal hydride battery, a nickel-cadmium battery), or a lithium-based battery (e.g., a lithium-cobalt battery, a lithium-phosphate battery, a lithium titanate battery, or a lithium-polymer battery).

The controller 12 controls the overall operation of the aerosol generating device 1. More specifically, the controller 12 controls not only operation of the battery 11 and the heater 13, but also operation of other components included within the aerosol generating device 1. In addition, the controller 12 may check the state of each of the components of the aerosol generating device 1 to determine whether the aerosol generating device 1 is in an operable state.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 is heated by electric power supplied by the battery 11, and may heat an aerosol generating article 2 inserted into the aerosol generating device 1. The aerosol generating article 2 may be inserted into the aerosol generating device 1 by the user, and the inserted aerosol generating article 2 may come into contact with the heater 13. For example, when the aerosol generating article 2 is inserted into the aerosol generating device 1, the heater 13 may be located outside the aerosol generating article 2. Therefore, the heated heater 13 may raise the temperature of the aerosol generating material in the aerosol generating article 2.

The heater 13 may include an electric resistive heater. For example, the heater 13 may include an electrically conductive track, and as current flows through the electrically conductive track, the heater 13 may be heated. However, the heater 13 is not limited thereto. The heater 13 may include any other types of heaters as long as it is able to be heated to a desired temperature. The desired temperature may be preset in the aerosol generating device 1, or may be set by the user.

According to another embodiment, the heater 13 may include an induction heating-type heater as illustrated in FIG. 2, which will be described later.

It has been illustrated in FIG. 1 that the heater 13 is tubular and arranged to surround the aerosol generating article along a longitudinal axis of the aerosol generating device 1. However, the shape and arrangement of the heater 13 are not limited thereto. For example, the heater 13 may include a plate-shaped heating element, a needle-shaped heating element, or a rod-shaped heating element, and may heat the inside and/or outside of the aerosol generating article depending on the shape of the heating element.

In addition, a plurality of heaters 13 may be arranged in the aerosol generating device 1. In that case, the plurality of heaters 13 may be arranged to be inserted into the aerosol generating article. Alternatively, the plurality of heaters 13 may be arranged outside the aerosol generating article. Alternatively, some of the plurality of heaters 13 may be arranged to be inserted into the aerosol generating article and the others may be arranged outside the aerosol generating article. The shape of the heater 13 is not limited to the shape illustrated in FIG. 1. The heater 13 may be manufactured in various shapes.

The aerosol generating device 1 may further include other components in addition to the battery 11, the controller 12, and the heater 13. For example, the aerosol generating device 1 may include a display capable of outputting visual information and/or a motor for outputting tactile information. The aerosol generating device 1 may also include at least one sensor (e.g., puff detection sensor, temperature detection sensor, aerosol generating article insertion detection sensor, and the like).

In addition, the aerosol generating device 1 may have a structure that allows external air to flow in and internal gas to exit even when the aerosol generating article 2 is inserted therein.

Although not illustrated in FIG. 1, the aerosol generating device 1 may be combined with a separate cradle. For example, the cradle may be used to charge the battery 11 of the aerosol generating device 1. The heater 13 may be heated in a state in which the cradle and the aerosol generating device 1 are combined with each other.

The aerosol generating article 2 may be similar to a common combustion-type cigarette. The aerosol generating article 2 may be divided into a first portion including the aerosol generating material and a second portion including the filter or the like. The second portion of the aerosol generating article 2 may include the aerosol generating material. For example, the aerosol generating material in the form of granules or capsules may be inserted into the second portion of the aerosol generating article 2.

The first portion may be completely inserted into the aerosol generating device 1 and the second portion may be exposed outside the aerosol generating device 1. Alternatively, only a portion of the first portion may be inserted into the aerosol generating device 1. Otherwise, the entire first portion and a portion of the second portion may be inserted into the aerosol generating device 1. The user may inhale the aerosol by biting the second portion. In that case, the aerosol is generated by external air passing through the first portion, and the generated aerosol passes through the second portion to be delivered to the user's mouth.

As an example, air from outside may flow in through at least one air passage formed within the aerosol generating device 1. For example, opening and closing of the air passage and/or the size of the air passage formed within the aerosol generating device 1 may be regulated by the user. Accordingly, the amount of atomization, a smoking taste, and the like may be adjusted by the user. As another example, air from outside may flow into the aerosol generating article 2 through at least one hole formed on a surface of the aerosol generating article 2.

FIG. 2 is a cross-sectional view schematically illustrating an aerosol generating system according to another embodiment of the present disclosure. Hereinafter, detailed descriptions that are the same as those described above will be omitted.

Referring to FIG. 2, the aerosol generating device 1 may include a coil 15 and a susceptor 14 as a heating body to generate an aerosol by heating an aerosol generating article by an induction heating method. The induction heating method may refer to a method of generating heat from a magnetic material by applying an alternating magnetic field that periodically changes its direction to the magnetic material that generates heat by an external magnetic field.

When the alternating magnetic field is applied to the magnetic material, energy loss may occur in the magnetic material due to eddy current loss and hysteresis loss, and the lost energy may be released from the magnetic material as thermal energy. The larger an amplitude or frequency of the alternating magnetic field applied to the magnetic material becomes, the more thermal energy may be released from the magnetic material. The aerosol generating device 1 may apply the alternating magnetic field to the magnetic material such that thermal energy is released from the magnetic material. Then, the thermal energy released from the magnetic material may be transferred to the aerosol generating article.

The magnetic material that generates heat by the external magnetic field may include a susceptor. The susceptor may be arranged in the aerosol generating device 1 while being included in the aerosol generating article in the form of fragments, flakes, or strips. The susceptor 14 may be arranged in the aerosol generating device 1.

According to embodiments, the susceptor may include metal or carbon. The susceptor may include at least one of ferrite, ferromagnetic alloy, stainless steel, and aluminum (Al). Alternatively, the susceptor may include at least one of ceramic such as graphite, molybdenum, silicon carbide, niobium, nickel alloy, metal film, zirconia, or the like, transition metal such as nickel (Ni), cobalt (Co), or the like, and metalloid such as boron (B) or phosphorus (P).

In the case of the aerosol generating device 1 according to another embodiment, the susceptor 14 may be included in a heater of the aerosol generating device 1. By arranging the susceptor 14 in the aerosol generating device 1 rather than in the aerosol generating article 2, there may be various advantages. For example, when a susceptor material is not uniformly distributed within the aerosol generating article, there is a problem in that the aerosol and a flavor are non-uniformly generated. However, such problem may be solved. In addition, since the aerosol generating device 1 is provided with the susceptor 14, a temperature of the susceptor 14 that generates heat by induction heating may be directly measured and provided to the aerosol generating device 1, and accordingly the temperature of the susceptor 14 may be precisely controlled.

The aerosol generating device 1 may include the coil 15 that applies the alternating magnetic field to the susceptor 14. That is, the coil 15 may be wound around a space in which the aerosol generating article is accommodated, and may be arranged at a position corresponding to the susceptor 14. The coil 15 may be supplied with electric power by the battery 11.

The controller 12 of the aerosol generating device 1 may control a current flowing through the coil 15 to generate a magnetic field, and induced current may be generated in the susceptor 14 under the influence of the magnetic field. Such induction heating is a well-known phenomenon that can be explained by Faraday's Law of induction and Ohm's Law. Briefly, induction heating refers to a phenomenon in which a changing electric field is generated in a conductor when magnetic induction in the conductor changes.

As the electric field is created in the conductor, eddy current flows through the conductor according to Ohm's Law, and the eddy current generates heat proportional to current density and conductor resistance. The heat generated within the susceptor 14 may be transferred to an aerosol generating material and then vaporize the aerosol generating material to generate the aerosol.

In other words, when electric power is supplied to the coil 15, a magnetic field may be formed inside the coil 15. When an alternating current is applied from the battery 11 to the coil 15, the magnetic field formed inside the coil 15 may periodically change direction. When the susceptor 14 disposed in the coil 15 is exposed to the alternating magnetic field, the susceptor 14 generates heat and the aerosol generating article 2 accommodated in the aerosol generating device 1 may be heated accordingly.

When the amplitude or frequency of the alternating magnetic field formed by the coil 15 changes, the temperature of the susceptor 14 that heats the aerosol generating article 2 may also change. The controller 12 may control electric power supplied to the coil 15 to regulate the amplitude or frequency of the alternating magnetic field formed by the coil 15, and accordingly the temperature of the susceptor 14 may be controlled.

As an example, the coil 15 may be implemented with a solenoid. A material of a conducting wire constituting the solenoid may include copper (Cu). However, embodiments of the present disclosure are not limited thereto. Silver (Ag), gold (Au), Al, tungsten (W), zinc (Zn), and Ni are materials that allow high current to flow with a low specific resistance. The material of the conducting wire constituting the solenoid may be any one of the above-described metal, or an alloy containing at least one thereof.

According to an embodiment, the aerosol generating device 1 may further include a temperature sensor (not shown) for measuring the temperature of the susceptor 14. The temperature sensor may include a kind of sensor that is not affected by the magnetic field applied by the coil 15.

The battery 11 of the aerosol generating device 1 may supply electric power needed for the coil 15 to create the magnetic field. An amount of electric power supplied to the coil 15 may be regulated by a control signal created by the controller 12.

The aerosol generating device 1 may include a converter that converts direct current supplied by the battery 11 into alternating current supplied to the coil 15, and may include a regulator that is disposed between the battery 11 and controller 12 and keeps a voltage of the battery 11 constant.

The controller 12 of the aerosol generating device 1 may generate and transmit a control signal to control overall operations of components included in the aerosol generating device 1 such as the battery 11, the coil 15, the susceptor 14, and the like. For example, the battery 12 may use the electric power from the battery 11 to apply current to the coil 15. In addition, the controller 12 may further include a pulse width modulation processor that controls the pulse width of electric power applied to the coil 15.

Figure 3:
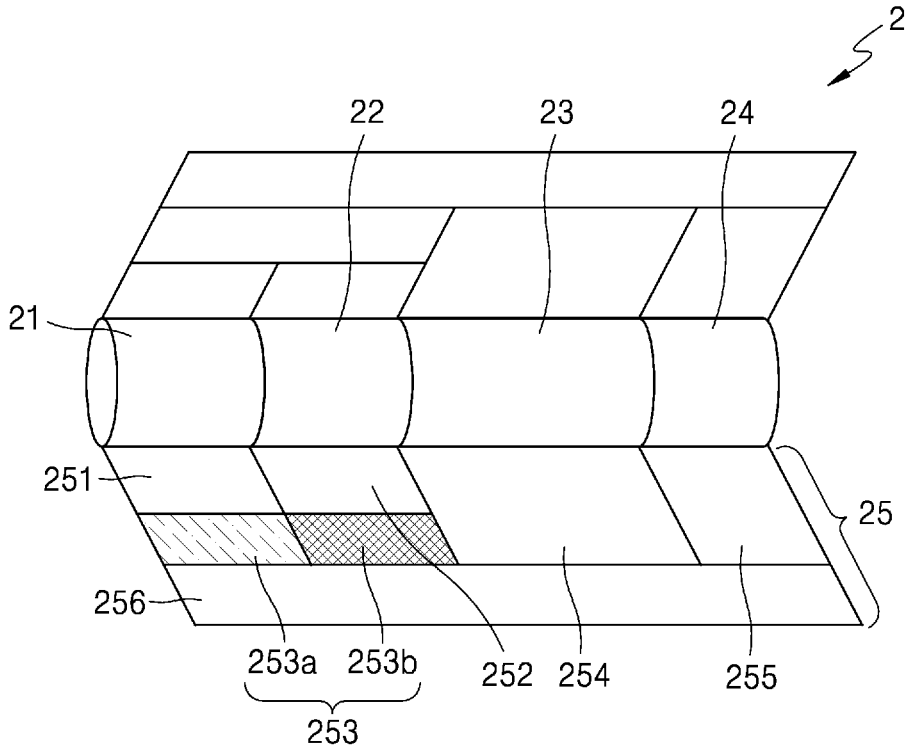
FIG. 3 is an exploded view illustrating an embodiment of an aerosol generating article accommodated in the aerosol generating systems illustrated in FIGS. 1 and 2.

FIG. 3 is an exploded view illustrating an embodiment of an aerosol generating article accommodated in the aerosol generating systems illustrated in FIGS. 1 and 2.

Referring to FIG. 3, the aerosol generating article 2 may include a base portion 21, a medium portion 22, a cooling portion 23, and a mouthpiece portion 24. The first portion that has been described in detail with reference to FIGS. 1 and 2 includes the base portion 21 and the medium portion 22, and the second portion that has been described in detail with reference to FIGS. 1 and 2 includes the cooling portion 23 and the mouthpiece portion 24.

According to the embodiment illustrated in FIG. 3, the medium portion 22 is arranged on one side of the base portion 21, the cooling portion 23 is arranged on one side of the medium portion 22, and the mouthpiece portion 24 is arranged on one side of the cooling portion 23. However, the arrangement order of each of the base portion 21, the medium portion 22, the cooling portion 23, and the mouthpiece portion 24 is not limited thereto. For example, the base portion 21 may be arranged at a downstream end of the medium portion 22.

The second portion including the cooling portion 23 and the mouthpiece portion 24 may also be referred to as a filter portion. In that case, the cooling portion 23 cools an aerosol, the mouthpiece portion 24 may filter certain ingredients included in the aerosol, and the filter portion may further include at least one segment that performs other functions.

The aerosol generating device 1 heats at least a portion of each of the base portion 21 and the medium portion 22 to generate the aerosol, and the generated aerosol may pass through the cooling portion 23 and the mouthpiece portion 24 to be delivered to a user.

The base portion 21 may contain moisturizer that supplies moisture to the aerosol. The moisturizer may include glycerin, propylene glycol (PG), and water. The moisturizer may further include at least one of ethylene glycol, dipropylene glycol, diethylene glycol, triethylene glycol, tetraethylene glycol, oleyl alcohol.

Therefore, the moisturizer included in the base portion 21 may maintain the moisture in the aerosol that is generated when the aerosol generating article 2 is heated to an appropriate level, thereby to soften the taste of a cigarette and enrich atomization.

The base portion 21 may store a liquid composition. For example, the liquid composition may include a liquid containing a tobacco-containing substance containing a volatile tobacco flavor ingredient or a liquid containing a non-tobacco substance.

For example, the liquid composition may include water, solvents, ethanol, plant extracts, spices, flavoring agents, or vitamin mixtures. The spices may include menthol, peppermint, spearmint oil, various fruit-flavored ingredients, and the like. However, embodiments of the present disclosure are not limited thereto. The flavoring agents may include ingredients that may provide the user with a variety of flavors or tastes. The vitamin mixtures may include a mixture of at least one of vitamin A, vitamin B, vitamin C, and vitamin E, but are not limited thereto.

Although not shown, the base portion 21 may include a porous matrix structure for containing the moisturizer and/or the liquid composition. The porous matrix structure may be made of porous ceramic or cellulose acetate. In that case, the moisturizer may be impregnated into the base portion 21 including the porous matrix structure. The structure of the base portion 21 is not limited thereto. The structure of the base portion 21 may include any structure that is able to contain the moisturizer and/or the liquid composition. For example, the base portion 21 may include a honeycomb structure.

The medium portion 22 may include a tobacco medium. Vapor and/or the aerosol are generated from the tobacco medium of the medium portion 22, and the generated vapor and/or aerosol may be inhaled by the user through the cooling portion 23 and the mouthpiece portion 24.

The medium portion 22 may include a solid material based on tobacco raw materials such as reconstituted tobacco sheet, shredded tobacco, reconstituted tobacco, and the like. According to an embodiment, the medium portion 22 may be filled with a corrugated reconstituted tobacco sheet. The reconstituted tobacco sheet may be wrinkled by being curled, folded, compressed, or contracted in a substantially transverse direction to a cylindrical axis. The distance between ridges and the like of the reconstituted tobacco sheet may be adjusted to control porosity.

According to another embodiment, the medium portion 22 may be filled with shredded tobacco. The shredded tobacco may be produced by finely cutting a tobacco sheet (or slurry leaf tobacco sheet). The medium portion 22 may be formed by combining a plurality of tobacco strands in the same direction (in parallel to one another) or randomly. More specifically, the medium portion 22 may be formed by combining the plurality of tobacco strands, and a plurality of longitudinal channels through which the aerosol may pass may be formed. In that case, depending on the size and arrangement of the tobacco strands, the longitudinal channels may be uniform or non-uniform.

The tobacco medium of the medium portion 22 may further include the moisturizer described above. In addition, the medium portion 22 may contain other additives such as flavoring agents and/or organic acid. The flavoring agents may include licorice, sucrose, fructose syrup, isosweet, cocoa, lavender, cinnamon, cardamom, celery, fenugreek, cascarilla, sandalwood, bergamot, geranium, honey essence, rose oil, vanilla, lemon oil, orange oil, mint oil, caraway, cognac, jasmine, chamomile, menthol, ylang-ylang, sage, spearmint, ginger, coriander, coffee, or the like.

The cooling portion 23 cools the aerosol generated by the heater 13 heating the base portion 21 and medium portion 22. Therefore, the user may inhale the aerosol cooled to a suitable temperature.

The cooling portion 23 may be formed by a crimped polymer sheet. Here, the polymer sheet may be made of materials selected from a group consisting of polyethylene (PE), polypropylene (PP), polyvinyl chloride (PVC), polyethylene terephthalate (PET), polylactic acid (PLA), cellulose acetate (CA), and aluminum foil. As the cooling portion 23 is formed by the crimped polymer sheet, the cooling portion 23 may include a plurality of channels extending in a longitudinal direction. Here, the channel refers to a passage through which a gas (e.g., air or aerosol) passes. According to another embodiment, the cooling portion 23 may be made of PLA alone or a combination of other degradable polymers and PLA.

The cooling portion 23 may include a thread containing a volatile flavor ingredient. Here, the volatile flavor ingredient may include menthol. However, embodiments of the present disclosure are not limited thereto. For example, the thread may be filled with an adequate amount of menthol for the cooling portion 23 to be provided with the menthol.

The mouthpiece portion 24 may include a cellulose acetate filter. For example, the mouthpiece portion 24 may be made of a recess filter. However, embodiments of the present disclosure are not limited thereto.

In the process of manufacturing the mouthpiece portion 24, a flavor may be provided by spraying a fragrance liquid to the mouthpiece portion 24. Alternatively, a separate fiber onto which the fragrance liquid is applied may be inserted into the mouthpiece portion 24. The aerosol generated from the base portion 21 and/or the medium portion 22 is cooled while passing through the cooling portion 23, and the cooled aerosol is delivered to the user through the mouthpiece portion 24. Therefore, when a fragrance element is added to the mouthpiece portion 24, the flavor delivered to the user may last for a long time. The mouthpiece portion 24 may include at least one capsule. Here, the capsule may include a structure in which a content liquid containing a spice is wrapped with a film. The capsule may have a spherical or cylindrical shape. However, embodiments of the present disclosure are not limited thereto.

Although not shown, the aerosol generating article 2 may further include a front end plug. The front end plug may be located on an upstream end portion side of the base portion 21. The front end plug may prevent the base portion 21 from falling out of the aerosol generating article 2, and may prevent the liquefied aerosol from leaking into the aerosol generating device 1 from the base portion 21 during smoking.

The aerosol generating article 2 may be packaged by a wrapper 25. For example, the base portion 21 may be packaged by a first wrapper 251, and the medium portion 22 may be packaged by a second wrapper 252. In addition, the cooling portion 23 may be packaged by a third wrapper 254, and the mouthpiece portion 24 may be packaged by a fourth wrapper 255.

A thermally conductive wrapper 253 may surround the first wrapper 251 and the second wrapper 252. In other words, the base portion 21 and the medium portion 22 of the aerosol generating article 2 may be further packaged by the thermally conductive wrapper 253.

The thermally conductive wrapper 253 surrounds at least a portion of each of the base portion 21 and the medium portion 22. For example, the thermally conductive wrapper 253 may include metal foil such as aluminum foil. However, embodiments of the present disclosure are not limited thereto. For example, the thermally conductive wrapper 253 may be made from a paramagnetic material such as aluminum, platinum, rutinium, or the like. The thermally conductive wrapper 253 surrounding the base portion 21 and the medium portion 22 may evenly disperse heat transferred to the base portion 21 and the medium portion 22 from the heater 13 to increase thermal conductivity of the base portion 21 and the medium portion 22, thereby improving taste of the aerosol generated from the base portion 21 and the medium portion 22.

It is desirable that a temperature at which a material contained in the base portion 21 is vaporized be higher than a temperature at which a material contained in the medium portion 22 is vaporized. For example, when used, an appropriate temperature of the base portion 21 may be about 180° C. to about 200° C., and an appropriate temperature of the medium portion 22 may be about 150 to about 170° C.

The thermally conductive wrapper 253 may include a first wrapper portion 253*a* surrounding the base portion 21 and a second wrapper portion 253*b* surrounding the medium portion 22. In this case, the amount of heat transferred through the first wrapper portion 253*a* may be greater than the amount of heat transferred through the second wrapper portion 253*b*.

For example, a thickness of the first wrapper portion 253*a* of the thermally conductive wrapper 253 may be less than a thickness of the second wrapper portion 253*b* of the thermally conductive wrapper 253. As another example, a surface area of the base portion 21 surrounded by the first wrapper portion 253*a* may be greater than a surface area of the medium portion 22 surrounded by the second wrapper portion 253*b*. As another example, a thermal conductivity coefficient of the first wrapper portion 253*a* may be greater than a thermal conductivity coefficient of the second wrapper portion 253*b*. To that end, the first wrapper portion 253*a* and the second wrapper portion 253*b* of the thermally conductive wrapper 253 may be made of different materials. The configuration of the first wrapper portion 253*a* and the second wrapper portion 253*b* of the thermally conductive wrapper 253 is not limited thereto, and various modifications may be made.

A fifth wrapper 256 may be surrounded by outer edges of the thermally conductive wrapper 253, the third wrapper 254, and the fourth wrapper 255. In other words, the base portion 21, the medium portion 22, the cooling portion 23, and the mouthpiece portion 24 of the aerosol generating article 2 may be further packaged by the fifth wrapper 256.

The first wrapper 251, the second wrapper 252, and the fifth wrapper 256 may be made of general plug wrap paper. For example, the first wrapper 251, the second wrapper 252, and the fifth wrapper 256 may include porous or non-porous plug wrap paper. The third wrapper 254 and the fourth wrapper 255 may be made of hard plug wrap paper.

The fifth wrapper 256 may be impregnated with a certain material. Here, an example of the certain material may include silicon. However, embodiments of the present disclosure are not limited thereto. Silicon has characteristics such as consistent heat resistance, oxidation resistance, resistance to various chemicals, water repellency, and electrical insulation. However, even if it is not silicon, any material having the above-described characteristics may be applied (or coated) to the fifth wrapper 256.

The fifth wrapper 256 may prevent the aerosol generating article 2 from burning. For example, when the base portion 21 and the medium portion 22 are heated by the heater 13, there is a possibility that the aerosol generating article 2 is burned. More specifically, when the temperature of any one of materials included in the base portion 21 and the medium portion 22 increases above the ignition point, the aerosol generating article 2 may be burned. Even in that case, since the fifth wrapper 256 includes a non-combustible material, the aerosol generating article 2 may be prevented from being burned.

In addition, the fifth wrapper 256 may prevent the aerosol generating device 1 from being contaminated by substances generated from the aerosol generating article 2. Liquid substances may be produced within the aerosol generating article 2 by the user's puff. For example, as the aerosol generated from the aerosol generating article 2 is cooled by air from outside, the liquid substances (e.g., moisture and the like) may be produced. As the fifth wrapper 256 packages the base portion 21, the medium portion 22, the cooling portion 23, and the mouthpiece portion 24, the liquid substances produced within the aerosol generating article 2 may be prevented from leaking out of the aerosol generating article 2. Therefore, the inside of the aerosol generating device 1 may be prevented from being contaminated by the liquid substances produced within the aerosol generating article 2.

Figure 4:
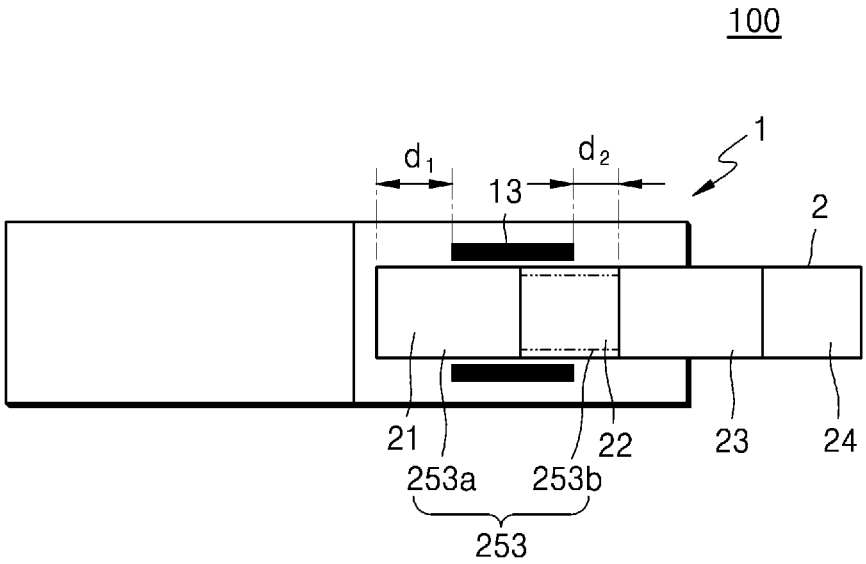
FIG. 4 is a cross-sectional view schematically illustrating an aerosol generating system in which the aerosol generating article illustrated in FIG. 3 is accommodated in an aerosol generating device according to an embodiment.

FIG. 4 is a cross-sectional view schematically illustrating an aerosol generating system in which the aerosol generating article illustrated in FIG. 3 is accommodated in an aerosol generating device according to an embodiment.

Referring to FIG. 4, when the aerosol generating article 2 is inserted into the aerosol generating device 1, the heater 13 of the aerosol generating device 1 may be arranged to face at least a portion of each of the base portion 21 and the medium portion 22 of the aerosol generating article 2. For example, the heater 13 may be arranged to surround at least a portion of each of the base portion 21 and the medium portion 22 of the aerosol generating article 2. Therefore, the heater 13 may heat at least a portion of each of the base portion 21 and the medium portion 22. Heat generated from the heater 13 of the aerosol generating device 1 may be transferred to the base portion 21 through the first wrapper portion 253*a* of the thermally conductive wrapper 253. In addition, the heat generated from the heater 13 of the aerosol generating device 1 may be transferred to the medium portion 22 through the second wrapper portion 253*b* of the thermally conductive wrapper 253.

FIG. 4 illustrates that a length of the heater 13 is less than a sum of a length of the base portion 21 and a length of the medium portion 22. However, embodiments of the present disclosure are not limited thereto. The length of the heater may be equal to the sum of the length of the base portion 21 and the length of the medium portion 22. The length of the heater 13 refers to the length of the heater 13 that extends along the aerosol generating article 2. Since the base portion 21 and the medium portion 22 are surrounded by the thermally conductive wrapper 253, even if the length of the heater 13 is less than or equal to the sum of the length of the base portion 21 and the length of the medium portion 22, an adequate amount of heat may be transferred to the base portion 21 and the medium portion 22. Accordingly, the amount of electric power consumed by the heater 13 may be reduced.

As described above, it is desirable that a temperature at which a material contained in the base portion 21 is vaporized be higher than a temperature at which a material contained in the medium portion 22 is vaporized. Therefore, in order to heat the base portion 21 to a temperature higher than the medium portion 22, a surface area of the base portion 21 surrounded by the heater 13 may be larger than a surface area of the medium portion 22 surrounded by the heater 13. For example, a ratio of the surface area of the medium portion 22 surrounded by the heater 13 to the surface area of the base portion 21 surrounded by the heater 13 may be within a range of 0.5 to 0.9, preferably within a range of 0.6 to 0.8. As such, a burned taste due to overheating of the medium portion 22 may be prevented. In addition, since the base portion 21 is able to be heated to a high temperature, sufficient vapor may be generated.

Since the base portion 21 is heated to a higher temperature than the medium portion 22, it is desirable that the base portion 21 be arranged upstream of the medium portion 22 to prevent excessive heat from being transferred to a user. Further, since the medium portion 22 located downstream of the base portion 21 is heated to a temperature lower than the base portion 21, a temperature of an aerosol entering the cooling portion 23 may be lowered, thus increasing a cooling effect of the aerosol.

Since the heater 13 is heated to a high temperature, in order to prevent a material of the cooling portion 23 from being deformed by heat and to secure a distance between the user and a heat source, a downstream end portion of the heater 13 may be spaced apart from the cooling portion 23 in the longitudinal direction of the aerosol generating article 2. In that case, a distance dl between an upstream end portion of the base portion 21 and an upstream end portion of the heater 13 may be less than a distance d2 between an upstream end portion of the cooling portion 23 and a downstream end portion of the heater 13. Therefore, the heater 13 and the cooling portion 23 may be securely spaced apart from each other to prevent the material of the cooling portion 23 from receiving excessive heat, and the heater 13 may surround a large portion of the base portion 21 to transfer adequate heat to the base portion 21.

Figure 5:
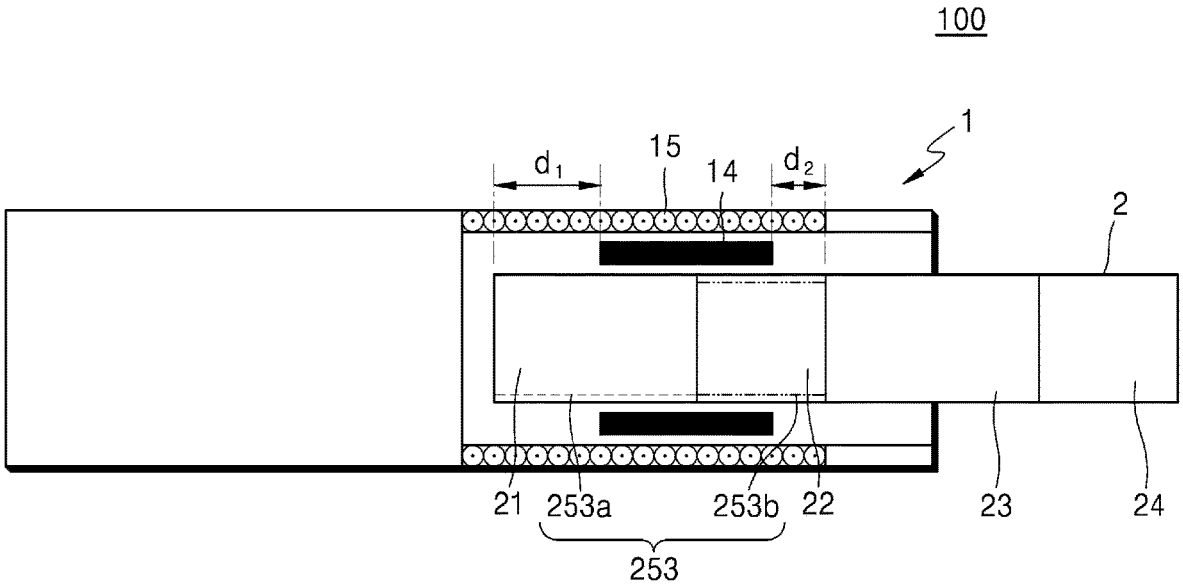
FIG. 5 is a cross-sectional view schematically illustrating an aerosol generating system in which the aerosol generating article illustrated in FIG. 3 is accommodated in an aerosol generating device according to another embodiment.

FIG. 5 is a cross-sectional view schematically illustrating an aerosol generating system in which the aerosol generating article illustrated in FIG. 3 is accommodated in an aerosol generating device according to another embodiment.

Referring to FIG. 5, the susceptor 14 and the coil 15 of the aerosol generating device 1 may be arranged at positions corresponding to the positions of the base portion 21 and the medium portion 22 of the aerosol generating article 2. Also, the susceptor 14 may be arranged to surround at least a portion of each of the base portion 21 and the medium portion 22 of the aerosol generating article 2 to heat at least a portion of each of the base portion 21 and the medium portion 22.

It has been illustrated that a length of the susceptor 14 is less than the sum of the length of the base portion 21 and the length of the medium portion 22. However, embodiments of the present disclosure are not limited thereto. The length of the susceptor 14 may be equal to the sum of the length of the base portion 21 and the length of the medium portion 22. Since the base portion 21 and the medium portion 22 are surrounded by the thermally conductive wrapper 253, even if the length of the susceptor 14 is less than or equal to the sum of the length of the base portion 21 and the length of the medium portion 22, an adequate amount of heat may be transferred to the base portion 21 and the medium portion 22. Accordingly, the amount of electric power consumed by the susceptor 14 and the coil 15 may be reduced.

FIG. 5 illustrates that the coil 15 extends from a bottom of a space in which the aerosol generating article 2 is accommodated to a downstream end portion of the medium portion 22. However, embodiments of the present disclosure are not limited thereto. For example, the coil 15 may extend from an upstream end portion of the base portion 21 to a downstream end portion of the medium portion 22. As another example, the coil 15 may have the same length as the susceptor 14, and at the same time it may be arranged at a position corresponding to the susceptor 14.

The embodiment of FIG. 5 illustrates an aerosol generating system in which an aerosol generating article is heated by an induction heating method. Compared with the embodiment of FIG. 4 in which an aerosol generating article is directly heated by a heater, the embodiment of FIG. 4 and the embodiment of FIG. 5 are similar to each other except that the heater 13 includes the susceptor 14 and the coil 15 in FIG. 5. The surface area of the base portion 21 surrounded by the susceptor 14 may be larger than a surface area of the medium portion 22 surrounded by the susceptor 14. For example, a ratio of the surface area of the medium portion 22 surrounded by the susceptor 14 to the surface area of the base portion 21 surrounded by the susceptor 14 may be within a range of 0.5 to 0.9, preferably within a range of 0.6 to 0.8.

A downstream end portion of the susceptor 14 may be spaced apart from the cooling portion 23 in the longitudinal direction of the aerosol generating article 2. In that case, the distance d1 between an upstream end portion of the base portion 21 and an upstream end portion of the susceptor 14 may be less than the distance d2 between an upstream end portion of the cooling portion 23 and a downstream end portion of the susceptor 14.

Although not shown in FIGS. 4 and 5, the aerosol generating device 1 according to an embodiment may include a sensor that is able to detect whether the aerosol generating article 2 is accommodated in the aerosol generating device 1. The sensor may be arranged at both end portions of the heater 13 or the susceptor 14. In that case, if the heater 13 or the susceptor 14 extends to an area in which the sensor is arranged, a detection area of the sensor may be blocked and sensitivity of the sensor may be reduced. Therefore, it is desirable that both end portions of the heater 13 or the susceptor 14 be spaced apart from an upstream end portion of the base portion 21 and an end portion of the medium portion 22, respectively, in the longitudinal direction of the aerosol generating article 2.

At least one of the components, elements, modules or units (collectively "components" in this paragraph) represented by a block in the drawings, such as the controller 12 in FIGS. 1-2, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like. The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

What is claimed is:

1. An aerosol generating system comprising:

an aerosol generating device comprising a battery and a heater configured to generate heat from electric power supplied by the battery; and an aerosol generating article accommodated in the aerosol generating device and configured to generate an aerosol when heated by the heater, wherein the aerosol generating article comprises:

a base portion comprising a liquid composition and configured to generate the aerosol when heated;

a medium portion comprising a tobacco medium and arranged at a downstream end of the base portion; and a thermally conductive wrapper surrounding at least a portion of each of the base portion and the medium portion, and configured to transfer heat from the heater, wherein a surface area of the base portion surrounded by the heater is larger than a surface area of the medium portion surrounded by the heater such that the base portion is heated to a higher temperature than the medium portion, wherein a downstream end of the heater is spaced apart from a downstream end of the medium portion in an upstream direction that extends parallel to a longitudinal direction of the aerosol generating article, and wherein an upstream end of the heater is spaced apart from an upstream end of the base portion in a downstream direction that extends parallel to the longitudinal direction.

2. The aerosol generating system of claim 1, wherein a ratio of the surface area of the medium portion surrounded by the heater to the surface area of the base portion surrounded by the heater is within a range of 0.5 to 0.9.

3. The aerosol generating system of claim 1, wherein the aerosol generating article further comprises a cooling portion arranged at a the downstream end of the medium portion, and the downstream end of the heater is spaced apart from the cooling portion in the upstream direction.

4. The aerosol generating system of claim 3, wherein the aerosol generating article further comprises a mouthpiece portion arranged at a downstream end of the cooling portion, and a distance between the downstream end of the heater and an upstream end of the cooling portion is greater than a distance between the upstream end of the heater and the upstream end of the base portion.

5. An aerosol generating system comprising:

an aerosol generating device comprising a battery and a heater configured to generate heat from electric power supplied by the battery; and an aerosol generating article accommodated in the aerosol generating device and configured to generate an aerosol when heated by the heater, wherein the aerosol generating article comprises:

a base portion comprising a liquid composition and configured to generate the aerosol when heated;

a medium portion comprising a tobacco medium and arranged at a downstream end of the base portion; and a thermally conductive wrapper surrounding at least a portion of each of the base portion and the medium portion, and configured to transfer heat from the heater, wherein the heater comprises:

a coil surrounding at least a portion of the aerosol generating article and configured to generate an induced magnetic field; and a susceptor including a ferromagnetic substance arranged between the coil and the aerosol generating article to generate heat resulting from the induced magnetic field, wherein the susceptor is arranged to surround the aerosol generating article to heat at least a portion of each of the base portion and the medium portion, wherein a surface area of the base portion surrounded by the susceptor is larger than a surface area of the medium portion surrounded by the susceptor, wherein a downstream end of the susceptor is spaced apart from a downstream end of the medium portion in an upstream direction that extends parallel to a longitudinal direction of the aerosol generating article, and wherein an upstream end of the susceptor is spaced apart from an upstream end of the base portion in a downstream direction that extends parallel to the longitudinal direction.

6. The aerosol generating system of claim 5, wherein a ratio of the surface area of the medium portion surrounded by the susceptor to the surface area of the base portion surrounded by the susceptor is within a range of 0.5 to 0.9.

7. The aerosol generating system of claim 6, wherein the aerosol generating article further comprises a cooling portion arranged at the downstream end of the medium portion, and the downstream end of the susceptor is spaced apart from the cooling portion in the upstream direction.

8. The aerosol generating system of claim 7, wherein the aerosol generating article further comprises a mouthpiece portion arranged at a downstream end of the cooling portion, and a distance between the downstream end of the susceptor and an upstream end of the cooling portion is greater than a distance between the upstream end of the susceptor and the upstream end of the base portion.

9. The aerosol generating system of claim 1, wherein the thermally conductive wrapper comprises a first wrapper portion surrounding the base portion and a second wrapper portion surrounding the medium portion, and an amount of heat transferred through the first wrapper portion is greater than an amount of heat transferred through the second wrapper portion.

10. The aerosol generating system of claim 1, wherein the base portion defines an upstream end of the aerosol generating article.

11. The aerosol generating system of claim 1, wherein the upstream end of the heater is a first distance away from the upstream end of the base portion in the longitudinal direction, wherein the downstream end of the heater is a second distance away from the downstream end of the medium portion in the longitudinal direction, and wherein the first distance is less than the second distance.

12. An aerosol generating device comprising:

a space configured to accommodate an aerosol generating article that generates an aerosol when heated;

a battery; and a heater configured to generate heat from electric power supplied by the battery, wherein the aerosol generating article comprises a base portion that comprises a liquid composition and generates the aerosol when heated, a medium portion comprising a tobacco medium and arranged at a downstream end of the base portion, and a thermally conductive wrapper surrounding at least a portion of each of the base portion and the medium portion, wherein a surface area of the base portion surrounded by the heater is larger than a surface area of the medium portion surrounded by the heater such that the base portion is heated to a higher temperature than the medium portion, wherein a downstream end of the heater is spaced apart from a downstream end of the medium portion in an upstream direction that extends parallel to a longitudinal direction of the aerosol generating article, and wherein an upstream end of the heater is spaced apart from an upstream end of the base portion in a downstream direction that extends parallel to the longitudinal direction.

13. The aerosol generating device of claim 12, wherein the heater comprises:

a coil surrounding at least a portion of the aerosol generating article to create an induced magnetic field; and a susceptor including a ferromagnetic substance and arranged between the coil and the aerosol generating article to generate heat resulting from the induced magnetic field.

* * * * *